United States Patent [19]

Minowa

[11] Patent Number: 4,844,632

[45] Date of Patent: Jul. 4, 1989

[54] HEAD BIASING MECHANISM IN A THERMAL PRINTER

[75] Inventor: Masahiro Minowa, Nagano, Japan

[73] Assignee: Kabushiki Kaisha Seiko Epson, Tokyo, Japan

[21] Appl. No.: 902,271

[22] Filed: Aug. 29, 1986

[30] Foreign Application Priority Data

| | | | |
|---|---|---|---|
| Aug. 29, 1985 | [JP] | Japan | 60-190762 |
| Feb. 28, 1986 | [JP] | Japan | 61-43221 |
| Feb. 28, 1986 | [JP] | Japan | 61-43222 |
| Mar. 4, 1986 | [JP] | Japan | 61-46712 |

[51] Int. Cl.[4] ..... B41J 3/20

[52] U.S. Cl. ..... 400/120; 346/76 PH

[58] Field of Search ..... 400/55, 56, 57, 120, 400/185, 352, 353, 355, 356; 346/76 PH

[56] References Cited

U.S. PATENT DOCUMENTS

| | | | |
|---|---|---|---|
| 3,810,192 | 5/1974 | Okabe | 400/120 |
| 4,173,273 | 11/1979 | Hanakata | 400/120 |
| 4,420,269 | 12/1983 | Ackermann et al. | 400/356 |
| 4,528,572 | 7/1985 | Sasaki et al. | 400/120 |
| 4,595,936 | 6/1986 | Nakajima et al. | 400/120 |
| 4,651,165 | 3/1987 | Shimada | 400/120 |

FOREIGN PATENT DOCUMENTS

| | | | |
|---|---|---|---|
| 53-70447 | 6/1978 | Japan . | |
| 58-29438 | 2/1983 | Japan | 400/120 |
| 131264 | 7/1985 | Japan | 400/120 |
| 137672 | 7/1985 | Japan | 400/120 |
| 137676 | 7/1985 | Japan | 400/120 |
| 143981 | 7/1985 | Japan | 400/120 |
| 161162 | 8/1985 | Japan | 400/120 |
| 183176 | 9/1985 | Japan | 400/120 |
| 212363 | 10/1985 | Japan | 400/120 |
| 255462 | 12/1985 | Japan | 400/120 |

OTHER PUBLICATIONS

J. R. Perry; "Thermal Print Head Control"; *IBM Technical Disclosure Bulletin; vol. 21. No. 4, pp. 1594–1595; Sep. 1978.*

IBM Bulletin vol. 24, No. 7B, Dec. 1981 "Energy Control for a Thermal Printer".

*Primary Examiner*—David A. Wiecking

*Attorney, Agent, or Firm*—Blum Kaplan

[57] ABSTRACT

A thermal printer for printing on a printing sheet. A print head with print elements opposes a platen and the printing sheet is located between the print head and platen. A head up-down mechanism for moving the print head toward and away from the platen has a biasing mechanism, a head release mechanism, and a change mechanism. The biasing mechanism includes an elastic member for urging the print head against the platen at least two levels of biasing force in the head down position. The head release mechanism selectively relieves the biasing force on the print head. The change mechanism effects selection between at least two levels of the biasing force produced from the force generated by the elastic member. The biasing force is related to the head movement speed or sheet movement speed. The energy applied to the print elements is based on the biasing force. A detection of the smoothness of the paper results in a variation in the biasing force on the print head.

39 Claims, 6 Drawing Sheets

| PRINT MODE | HEAD BIASING FORCE | HEAD MOVEMENT SPEED | ENERGY APPLIED TO THE HEAD |
|---|---|---|---|
| HIGH QUALITY PRINT MODE | HIGH | LOW | HIGH |
| HIGH SPEED PRINT MODE | LOW | HIGH | LOW |

HEAD BIASING MECHANISM IN A THERMAL PRINTER

BACKGROUND OF THE INVENTION

The invention is generally directed to a thermal printer and in particular to a thermal printer which has a biasing mechanism for selectively pressing the thermal head against the platen at various force levels to print on a variety of types of paper including rough bond paper. The widespread use of thermal printers has generated a need for thermal printers, especially serial type thermal printers which are capable of high speed printing and high quality printing.

A thermal printer disclosed in Japanese Laid-Open Utility Model No. 58-29438 utilizes a variable force of the thermal head against thermal paper to change the color density. Two color levels of printing are obtained by using two levels of pressing force. However, this technique is inadequate for a thermal transfer printer.

A thermal printer, disclosed in Japanese Laid-Open Patent No. 60-131264 uses a roller or a humidifying means for increasing the smoothness of paper to be used in a thermal printer. The smoothness of the paper utilized is also detected.

It is known that the pressing force of a thermal head against the paper in a thermal printer, and especially in a thermal transfer printer, makes a great difference in print quality. Particularly when normal paper is used in a thermal printer, a large biasing force, pressing the head against the paper and platen, is required for quality printing. On the other hand, when smooth thermal transfer paper is used in a thermal printer, high speed printing is required. However, when a large biasing force is used, an increase in the load on the motor results in trailing of the printed dots and smearing of the paper due to the heat stored in the thermal head in high speed printing mode with resulting low print quality. The prior art thermal printers suffer from these disadvantages.

It has become necessary for commercial thermal printers to be able to print on normal (non-thermal) paper. However, many of the printers are unable to print on rough types of paper, such as the bond papers widely used in the United States. Where the thermal printers have been adapted to print on the rough paper, mechanical plungers, which are loud, have been utilized to vary the head pressure. As a result, the quiet printing which is a great benefit of the thermal printers is lost.

The prior art thermal printers are also large units which are difficult to handle. In addition, in order to achieve high print quality, in many cases prior art printers have found it necessary to increase the smoothness of the paper to achieve high quality printing. For example, the bond paper commonly used by businesses in the United States has a rough surface. However, the rough surface is changed by the prior art printing to increase the surface smoothness to aid in high quality printing. In addition, the prior art thermal printers process the paper through a humidifier, roller or other mechanism to smooth the paper which results in a decrease in printing speed.

Accordingly, there is a need for a thermal printer which is capable of selectively biasing the thermal head against the paper and platen at at least two levels; prints in both high quality and high speed modes by selecting a pressing force and a corresponding thermal head movements speed; is capable of printing on a variety of types of paper including rough bond paper; and utilizes a quiet mechanism for changing the pressing force of the thermal head to maintain the silent printing associated with thermal printers

SUMMARY OF THE INVENTION

The invention is generally directed to a thermal printer for printing on a printing sheet including a print head with print elements. A platen opposes the print head, and the printing sheet is located between the print head and platen. A head up-down mechanism for moving the print head toward and away from the platen has a biasing mechanism, a head release mechanism, and a change mechanism. The biasing mechanism includes an elastic member for urging the print head against the platen at at least two levels of biasing force in the head down position. The head release mechanism selectively relieves the biasing force on the print head. The change mechanism effects selection between at least two levels of the biasing force produced from the force generated by the elastic member.

Accordingly, it is an object of the invention to provide an improved thermal printer.

Another object of the invention is to provide a thermal printer which adjusts the biasing force of the print head against the platen based on the speed of movement of the print head.

A further object of the invention is to provide a thermal printer which changes the biasing force of the printing head against the platen based upon the detected smoothness of the paper in the printer.

Still another object of the invention is to provide a thermal printer which varies the energy applied to the print element of the thermal print head based upon the detected smoothness of the paper in the printer.

Yet another object of the invention is to provide a thermal printer capable of exerting at least two different levels of force on the print head against the platen and paper therebetween by use of a transmission lever rotatable about a fulcrum where the levels of force are changed by moving the fulcrum.

Yet a further object of the invention is to provide an improved printer capable of pressing the print head against the platen with at least two levels of force and a released position in which the print head separates from the platen to allow the insertion of a sheet of paper.

Still a further object of the invention is to provide an improved printer which is compact and can print with high quality and high speed by selecting a print head pressure force corresponding to the speed of movement of the thermal head and energy applied to the head.

Still another object of the invention is to provide a thermal printer which can print on rough paper such as the bond paper commonly used in the United States as letterhead or stationery.

Yet another object of the invention is to provide a thermal printer with a mechanism for changing the force applied to the thermal print head which maintains the quiet printing of thermal printers and which can be used with a variety of types of papers and at low cost.

Another object of the invention is to provide a thermal printer which has a biasing mechanism for urging the printing head against the platen with at least two levels of biasing force and a head movement mechanism which can change the speed of the movement or the print head relative to the paper where speed of the head relative to the paper is set by the head movement mechanism to correspond to the force of the printing head against the platen.

A further object of the invention is to provide a thermal printer which optimizes the energy applied to the print elements based on the speed of the thermal head relative to the paper.

A still further object of the invention is to provide a thermal printer which utilizes a smoothness sensor for detecting the roughness of the printing paper so that the force of the print head against the platen and the energy applied to the print elements can be optimized to the roughness of the paper without significantly smoothing the paper.

Still other objects of the invention will in part be obvious and will in part be apparent from the specification.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
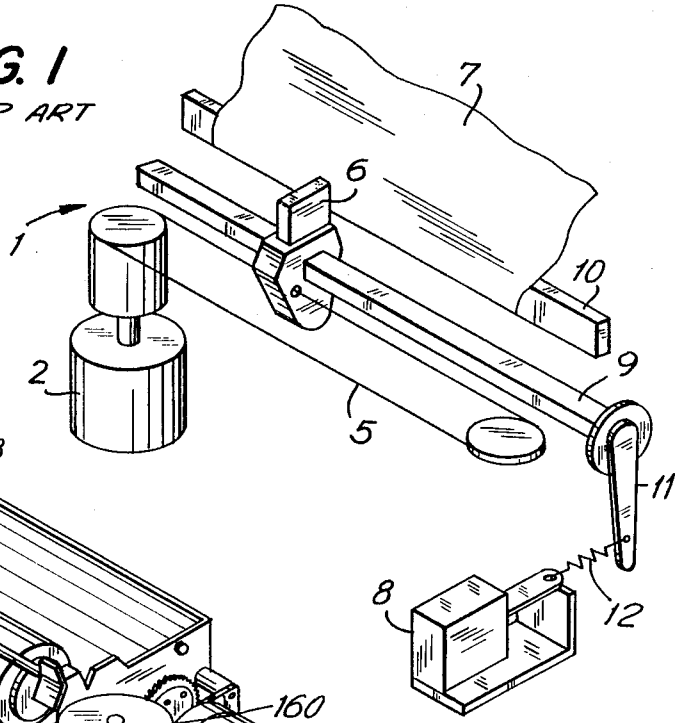
FIG. 1 PRIOR ART
FIG. 1 is a schematic elevational view of a thermal printer constructed in accordance with the prior art.

Reference is first made to FIG. 1 wherein a schematic view of a thermal printer of the type disclosed in Japanese Laid-Open Utility Model No. 58-29438 is shown. The thermal printer, shown, generally as reference numeral 1, includes a thermal head 6 having one or more heating elements arranged thereon. A motor 2 is used as a driving source for moving thermal head 6 with a belt 5 which transmits the driving power from motor 2 to thermal head 6. A guide shaft 9 guides the movement of head 6 and transmits the biasing force of thermal head 6 against a platen 10 and paper 7. A mechanical plunger 8 functions as a switch between the two levels of force applied by print head 6 against sheet of paper 7 and platen 10. Plunger 8 is a mechanical device which is noisy during its operation. Plunger 8 is coupled to guide shaft 9 by a lever arm 11 and spring 12. By movement of plunger 8 lever arm 11 is placed under a biasing force which is transmitted to thermal print head 6 as an increased contact force.

In a prior art thermal printer, the head pressing mechanism only functions to change the biasing force by means of a plunger. However, it does not have a head up-down function and thus can not be used in a thermal transfer printer.

The known printer shown in FIG. 1 provides two levels of color density printing by changing the color density in accordance with the variation in pressure exerted by the print head. However, this technique is inadequate for thermal transfer printing.

Figure 3:
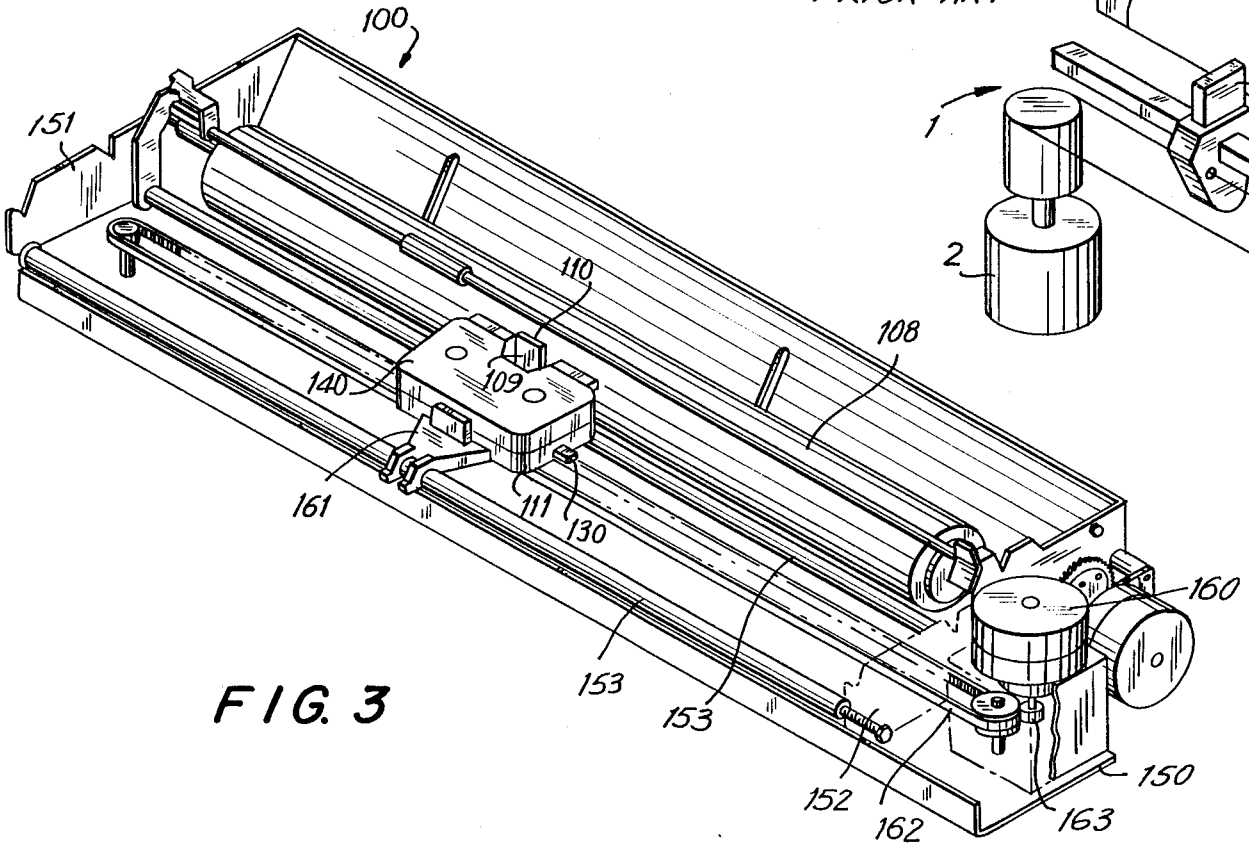
FIG. 3 is a perspective view of the mechanical elements of a thermal printer constructed in accordance with the first embodiment of the invention.
Figure 2B:
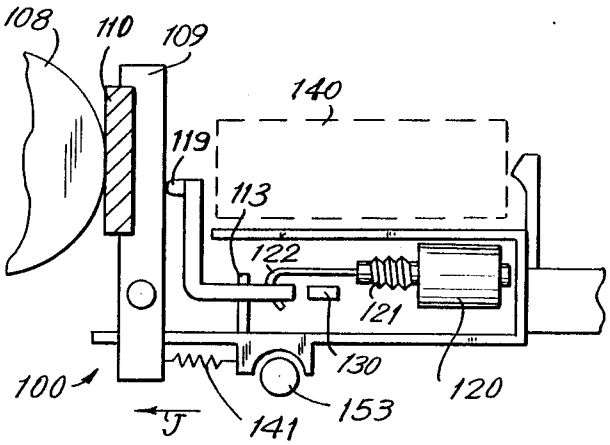
FIGS. 2A and 2B are a top plan view and side elevational view, both partially cut away for clarity purposes of the carriage of a thermal printer constructed in accordance with a first embodiment of the invention.
Figure 2A:
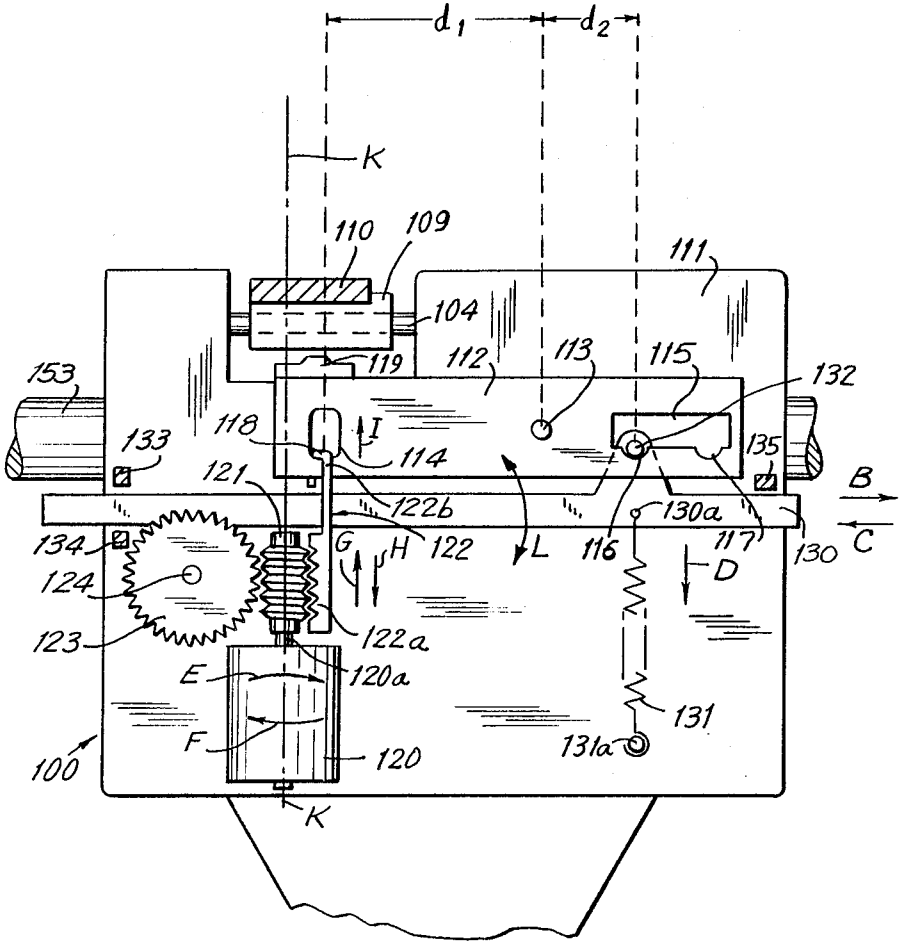

Reference is next made to FIGS. 2A and 2B wherein a thermal transfer printer having a thermal head as a printing head and heating elements as print elements, generally indicated as 100, constructed in accordance with a first embodiment of the invention is depicted. Only a portion of the carriage of printer 100 is shown in FIG. 2A and the walls of the printer and platen are shown in FIG. 3. FIG. 2B shows a portion of the platen.

Printer 100 includes a cylindrical platen 108 opposing a thermal print head 110, mounted on a radiating plate 109, both of which are mounted on carriage frame 111. A biasing force transmission lever 112 is pivotally mounted on a shaft 113. Transmission lever 112 has a tip region 119 for contacting the rear of radiating plate 109 to deliver the biasing force to print head 110 in the direction of arrow I. Transmission lever 112 has a first opening 114 and a second opening 115. Second opening 115 has two rounded notches 116 and 117 for adjusting the biasing forces as described below.

A motor 120 is used as a source of power for moving the thermal print head toward and away from the printing paper. Motor 120 has a motor shaft **120*a* with a worm gear 121 mounted thereon. Worm gear 121 engages with a head-up lever 122 having a gear portion 122*a* for engaging with worm gear 121 and a hook portion 122*b* for gripping the inside of opening 114 in transmission lever 112. Head-up lever 122 is coupled to worm gear 121 to reciprocate in the directions of arrows G and H (FIG. 2A). When motor 120 rotates in the direction of arrow F, worm gear 121 rotates in this direction causing head-up lever 122, due to the engagement of worm gear 121 and gear portion 122*a*, to move in the direction of arrow H. As a result of this movement, hook portion 122*b* engages with the bottom of opening 114 causing tip portion 119 to rotate about shaft 113 away from the rear of radiating plate 109. This relieves the biasing force on print head 110 and print head 110 is placed in the head-up position. Motor 120 is activated in this direction until tip 119 disengages from radiating plate 109 when no printing is to be performed, such as when a new sheet of paper is being inserted between platen 108 and print head 110**.

When motor 120 is rotated in the opposite direction (in the direction of arrow E), worm gear 121 rotates and causes head-up lever 122 to move in the direction of arrow G. This causes hook end **122*b* to disengage from opening 114 and allows the head biasing mechanism, described below, to operate in its normal manner and at this time print head 110 is located in the head-down position. In this way, motor 120 controls whether or not a biasing force is applied to print head 110**.

A gear 123 is mounted on a shaft 124 on carriage frame 111. Gear 123 meshes with worm gear 121 to transmit power for winding the ribbon in a ribbon cassette 140 (FIG. 2B) during printing.

A ratio changing lever 130 has an opening 130*a* and a pin 132. Lever 130 is biased in the direction of arrow D (FIG. 2A) by a spring 131 fixed at a first end to pin 131*a* and at its second end to opening 130*a* of lever 130. Pin 132 engages in one of rounded notches 116 and 117 in opening 115 of transmission lever 112. Lever 130 is supported proximate its other end between guides 133 and 134, which act as a fulcrum for movement along arc L. As shown in FIG. 2A, pin 132 engages with notch 116 of transmission lever 112. The biasing force caused by spring 131 (which is an elastic member), causes a downward force on notch 116. This in turn causes transmission lever 112 to rotate clockwise about shaft 113. As shown in FIG. 2A, the transmission lever 112 rotates clockwise with the left end of transmission lever 112, bearing tip 119, moving in the direction of arrow I and exerting a biasing force on print head 110 through radiating plate 109. A guide 135 prevents counterclockwise rotation of lever 130.

The biasing force applied by tip 119 is related to the ratio between distances $d_1$ and $d_2$ shown in FIG. 2A. Distance $d_1$ is the distance between the fulcrum (shaft 113) and the head biasing power application point 118 (tip 119). Distance $d_2$ is the distance between the fulcrum (shaft 113) and the biasing force application point (pin 132). As the ratio $d_2/d_1$ increases, the biasing force for a given spring strength is increased.

In the structure shown, distance $d_1$ remains constant. However, if lever 130 is moved in the direction of arrow B, pin 132 unseats from notch 116 and seats in notch 117. This has the effect of increasing the distance $d_2$ and thereby increasing the ratio $d_2/d_1$ and thereby also increasing the biasing force applied to print head 110 in the direction of arrow I.

Opening 115 in transmission lever 112 is shown as having two notches 116 and 117 designed to stabilize pin 132 in two predetermined positions. Opening 115 can be made with more notches to provide additional levels of biasing force. The structure can also be established keeping $d_2$ constant and varying $d_1$.

When printing ends, for example at the end of a page, motor 120 revolves in the direction of arrow F and head-up lever 122 is moved in the direction of arrow H to overcome the biasing force of coil spring 131. At this time, as power is. exerted in the direction of arrow J by compressing coil spring 141 (FIG. 2B), thermal head 110 is biased away from platen 108 to allow a new sheet of paper to be inserted and prevent smearing. The biasing force mechanism as described includes elastic member 131, change lever 130 and biasing force transmission lever 112.

As noted above, in accordance with the invention the head up-down mechanism includes the biasing force mechanism, the release mechanism and the change mechanism. The biasing force mechanism includes notches 116, 117, transmission lever 112, change lever 130, spring 131 and pin 132. The release mechanism includes motor 120, worm gear 121, head-up lever 122, opening 114 and spring 141. The change mechanism includes notches 116, 117, pin 132, change lever 130, side frames 151, 152 (FIG. 3), and motor 160 (FIG. 3).

Reference is next made to FIG. 3 wherein a perspective view of the overall mechanical construction of the printer 100 constructed in accordance with the first embodiment of the invention is depicted, like elements being identified by like reference numerals. Printer 100 includes a frame 150 and a stepping motor 160 which acts a driving source for moving a thermal head 110 along the axial direction of platen 108. A belt 162 in connection with a gear train 163 moves carriage 161 under the control of stepping motor 160. Carriage 161 is guided along two guides bars 153 which extend from left side frame 151 to right side frame 152.

As seen in FIGS. 2A and 3, lever 130 extends outward beyond the end of carriage frame 111. Accordingly, when a high speed print mode, requiring a low biasing force is selected, carriage 161 is pushed against right side frame 152 to move lever 130 in the direction of arrow C (FIG. 2A), change lever 130 from notch 117 to notch 116 where a lower resultant force is applied to print head 110. On the other hand, when a high quality print mode, requiring a high biasing force is selected, carriage 161 carrying thermal head 110 is pushed up against left side frame 151 by the driving force of stepping motor 160. This moves lever 130 in the direction of arrow B prior to printing. Pin 132 moves from notch 116 to notch 117 and thus exerts a greater biasing force on print head 110. During the normal course of printing, lever 130 never contacts either of the side frames 151, 152. Only when it is desired to change the biasing force does the carriage then move so that lever 130 is pushed by one of side walls 151 and 152. Other approaches are available where there are more than two notches 116, 117 each of which corresponds to a level of biasing force.

As a result, by extension of the principles utilized in the construction of FIG. 2A, different levels of head biasing force can be achieved by increasing the number of notches in opening 115 formed in biasing force transmission lever 112. Further, in accordance with this embodiment the force application point of coil spring 131 is variable. However, the same effect can be achieved by moving shaft 113 as the fulcrum to change the ratio $d_2/d_1$.

Figure 4:
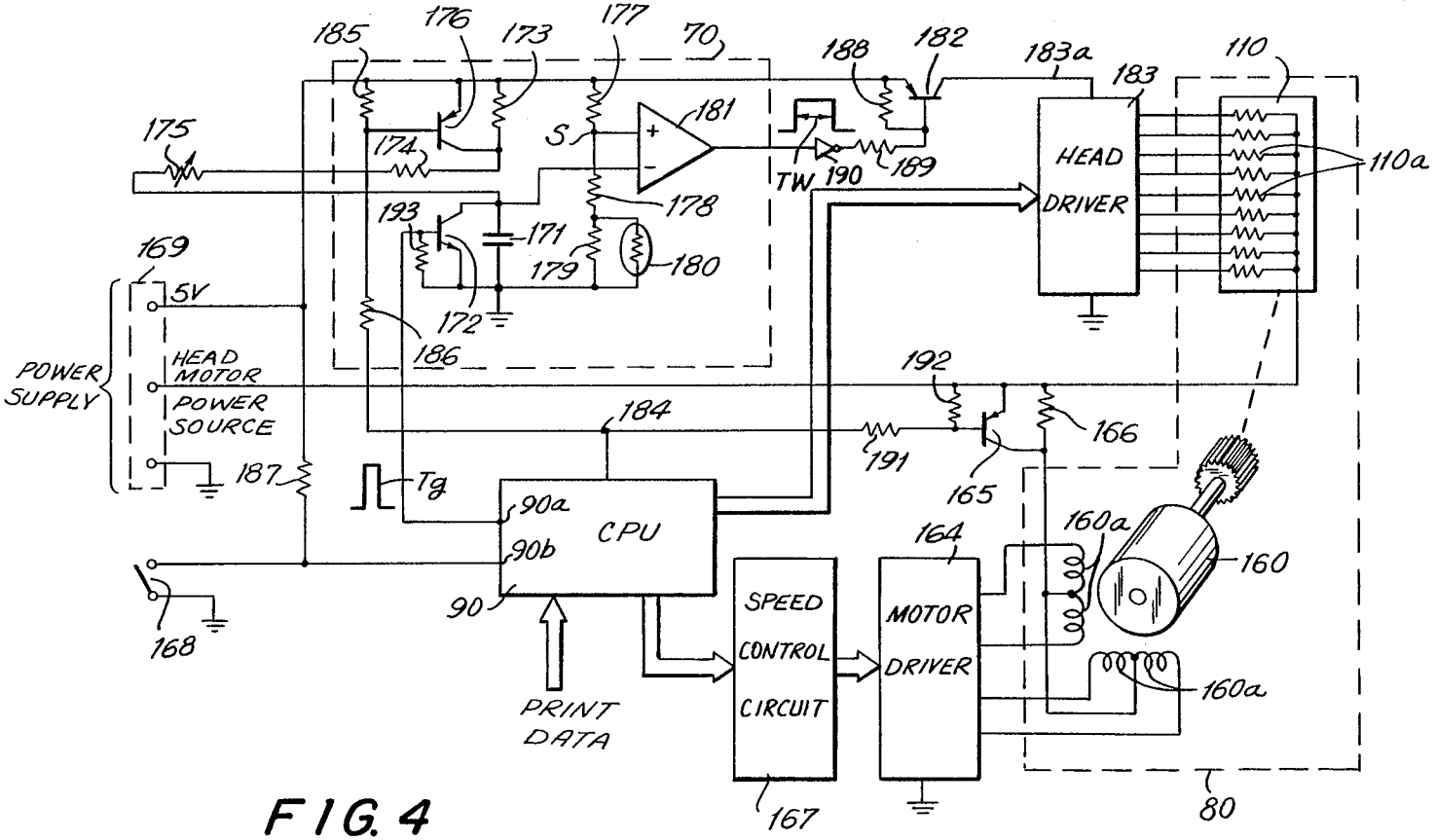
FIG. 4 is a schematic circuit diagram of the electrical and electromechanical components of a thermal printer constructed in accordance with a preferred embodiment of the invention.

Reference is next made to FIG. 4 wherein a circuit diagram of a thermal printer construction in accordance with a first embodiment of the invention is depicted, like reference numerals representing like parts. Dotted line box 80 indicates the mechanical and electromechanical parts of thermal printer 100 including heating elements 110*a* arranged on thermal print head 110 and coils 160*a* of stepping motor 160.

Dotted line box 70 is an energy control application circuit for determining the energy supplied to heating elements 110*a*. In accordance with the structure of circuit 70 two or more levels of energy can be supplied to heating elements 110*a* by changing the time during which they are energized.

Circuit 70 receives a voltage of five volts from power supply 169. A capacitor 171 is charged through a path including either resistor 173 or transistor 176 and resistor 174 and variable resistor 175. Capcitor 171 discharges through the collector-emitter path of transistor 172. One terminal of resistor 173 and the emitter terminal of transistor 176 are coupled to the five volt output of power supply 169. The other terminal of resistor 173 and the collector terminal of transistor 176 are coupled together to one terminal of resistor 174. The gate electrode of transistor 176 is coupled to the junction of series transistors 185 and 186 which are coupled between the five volt input voltage and a print mode output terminal 184 of CPU 90. The other terminal of resistor 174 is coupled to one terminal of variable resistor 175 which is outside of the general confines of circuit 70 so that it may be manually accessed as described below. The other terminal of variable resistor 175 is coupled to one terminal of capacitor 171. The other terminal of capacitor 171 is coupled to ground. The collector-emitter path of transistor 172 is coupled in parallel across capacitor 171. A biasing resistor 193 is coupled between the gate electrode of transistor 172 and ground. The gate electrode of transistor 172 is also coupled to a trigger terminal 90*a* of a CPU 90.

Resistors 177, 178 and 179 and thermistor 180 form a reference voltage circuit. Resistors 177, 178 and 179 are coupled in series between five volts and ground. Thermistor 180 is coupled in parallel across resistor 179. Thermistor 180 detects the ambient temperature or the temperature of thermal head 110 to supply an optimum energy to the heating elements 110*a* of thermal head 110.

A voltage comparator circuit 181 is turned on or off depending upon the level of charge of capacitor 171. A first input to voltage comparator circuit 181 is a junction S between series resistors 177 and 178 in the reference circuit. The second input to voltage comparator circuit 181 is the voltage at the junction between variable resistor 175 and capacitor 171 (the voltage across capacitor 171).

When the trigger input Tg is output to transistor 172 in synchronization with the print timing set by CPU 90 controlling the thermal printer, transistor 172 is turned on. This causes capacitor 171 to discharge. Transistor 172 is turned off after capacitor 171 is quickly discharged. Then, capacitor 171 begins to charge up through resistors 173, 174 and 175. The time required for the charge level of capacitor 171 to reach the reference potential of point S is output as the pulse width TW from voltage comparator circuit 181. As seen by the wave signal at the output of voltage comparator circuit 181 in FIG. 4, comparator 181 outputs a low level signal when the charge level of capacitor 171 is greater than the voltage of point S and outputs a high signal when the voltage at point S is greater than the voltage across capacitor 171, returning again to the low level after capacitor 171 charges beyond the voltage of point S.

Transistor 176 acts as a switch for changing the pulse width TW output from voltage comparator circuit 181. When transistor 176 is turned on capacitor 171 charges more quickly and the resulting pulse width TW is shorter. In contrast, when transistor 176 is turned off, capacitor 171 charges more slowly and the pulse width TW is longer. Variable resistor 175 is provided to allow manual changing of the color density of the dots from the outside of the thermal printer 100. This change affects the color density of printing to both high quality and high speed printing.

The output from energy application control circuit 70 is transmitted to a transistor 182 through an inverter 190 and a series resistor 189. A biasing resistor 188 couples the gate and emitter terminals of transistor 182. The collector terminal of transistor 182 is coupled to terminal 183 of head driver 183. The output from voltage comparator circuit 181 turns on or off the power supply terminal 183*a* of head driver 183. As a result, head driver 183 is operable during pulse width period TW. Thus the proper amount of energy is applied to heating elements 110*a*. The heating elements are selected for printing under the control of CPU 90.

A speed control circuit 167 is coupled to CPU 90. Speed control circuit 167 is also coupled to motor driver 164. Motor driver 164 is coupled to driving coils 160*a* of motor 160. A voltage controlling transistor 165 controls the voltage applied to driving coils 160*a*. The emitter terminal of transistor 165 is coupled to the head motor power source output of power supply 169. The base terminal of transistor 165 is coupled to the head motor power source through a biasing resistor 192 and the collector terminal of transistor 165 is coupled to the head motor power source through a biasing resistor 166.

Transistor 165 is coupled to print mode output terminal 84 of CPU 90 through a series resistor 191. A print mode change switch 168 selects between a high speed print mode and high quality print mode. One terminal of switch 168 is coupled to ground and the other terminal of switch 168 is coupled to input terminal 90*b* of CPU 90.

When a high speed print mode is selected by print mode change switch 168, a low level signal is output to print mode output terminal 184 by CPU 90. As a result, transistor 176 is turned on and a short pulse width TW is output from voltage comparator circuit 181. This results in heating elements 110*a* being energized for only a short period of time. In addition, voltage control transistor 165 is turned on and motor 160 is driven with a high voltage, thus producing high speed printing. In this mode, when print data is input to CPU 90, CPU 90 actuates motor 160 to reduce the biasing force of the biasing mechanism described above. As a result, printing is performed at high speed.

On the other hand, when a low speed, high quality print mode is selected by switch 168, a high level signal is output to print output mode terminal 184 by CPU 90. As a result, transistor 176 is turned off and a long pulse width TW is output from voltage comparator 181 and heating elements 110*a* are energized for a longer period of time. In addition, voltage control transistor 165 causes motor 160 to be driven at a low speed. Generally, as in a stepping motor, the voltage applied to driving coil 160*a* is reduced to prevent temperature buildup while the stepping motor is revolving at low speed. In addition, when the print data is input to CPU 90, CPU 90 increases the biasing force of the print head against the platen as described above. Thus, high quality, low speed printing is performed with driving motor 160 operating at low speed.

Speed control circuit 167 changes the drive frequency of stepping motor 160 in response to a command received from CPU 90. However, it is also possible to change the drive frequency by software means in CPU 90.

Figures 5, 7:
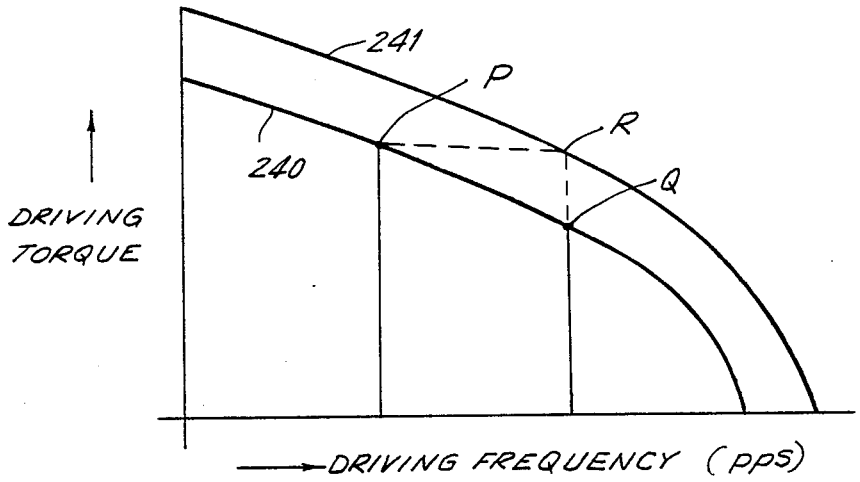
FIG. 5 is a table showing the relationship between print mode and the head biasing force, head movement speed and energy applied to the head in accordance with the invention.
FIG. 7 is a graphical representation of the characteristics of a stepping motor used as a driving force for the head movement mechanism in accordance with the invention.

Reference is next made to FIG. 5 wherein a table graphically depicts the relationship between the print mode and the head biasing force, head movement speed and energy applied to the head. As seen, in the high quality print mode, a high biasing force is applied to the head and the energy applied to the head is also high. However, the speed at which the head moves is slow. Where the high speed print mode is selected, the head moves quickly while the biasing force applied to the head and the energy applied is lowered.

Figure 6A:
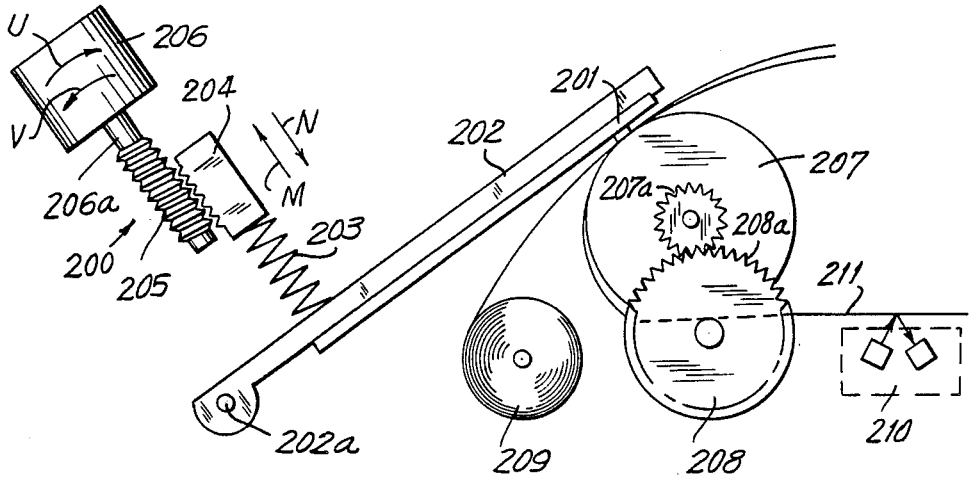
FIGS. 6A–6B show a cut away side elevational view of selected components and a circuit diagram, respectively, of a thermal printer constructed in accordance with a second embodiment of the invention.
Figure 6B:
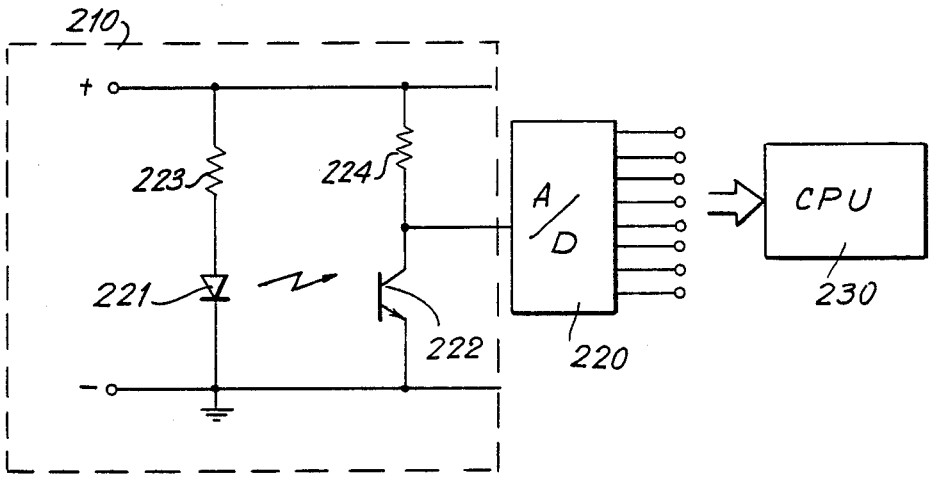

Reference is next made to FIGS. 6A and 6B wherein a thermal printer, generally indicated as 200, constructed in accordance with a second embodiment of the invention is depicted. FIG. 6A only shows the relevant parts of printer 200 and in other particulars printer 200 operates similarily to printer 100 as depicted in FIGS. 2A, 2B, 3 and 4.

Printer 200 includes a line type thermal head 201 provided with heating elements aligned in the direction of a printing column. Thermal head 201 is mounted on a head support member 202 which also serves as a radiating plate and is rotatable about a fulcrum point 202*a*. A compressing coil spring 203 is coupled at a first end to a positioning member 204 for determining the support position of the first end of spring 203. Positioning member 204 has threading for engaging with a worm gear 205 coupled to a motor shaft 206*a* extending outward from a motor 206. The other end of compressing coil spring 203 not coupled to positioning member 204 is coupled to the top surface (FIG. 6A) of head support member 202 and provides a biasing force downward.

Motor 206 is generally a stepping type motor and is capable of causing the rotation of motor shaft 206*a* in the directions of arrows U and V. Rotation of motor 206 in the direction of arrow V causes movement of the positioning member 204 in the direction of arrow N which has the effect of increasing the biasing force applied to head support member 202 and thermal head 201 through coil spring 203. On the other hand, when motor 206 rotates in the direction of arrow U, positioning member 204 moves in the direction of arrow M and reduces the biasing force exerted by compressing coil spring 203 on head support member 202 and thermal head 201.

A platen 207 opposes thermal head 201. Platen 207 is rotated by a motor 208 through a gear train including gear 208*a* associated with motor 208 and gear 207*a* associated with platen 207. As a result, motor 208 serves as a driving source for feeding a printing sheet 211 to thermal print head 201. A stepping motor, which is substantially silent, is generally used for motor 208. An ink ribbon 209 is fed between head 201 and paper 211. In addition, a reflective type photosensor 210, shown schematically in FIG. 6A is situated in the paper path to detect the smoothness of the paper.

In this embodiment, printing sheet 211 is moved relative to print head 201, although print head 110 is moved relative to a printing sheet in the embodiment of FIGS. 2A and 2B.

FIG. 6B is a circuit diagram of a reflective type photosensor 210 of the type shown schematically in FIG. 6A. Photosensor 210 includes a light emitting portion including a resistor 223 and light emitting diode 221. The detector portion includes resistor 224 and light receiving element 222.

The amount of reflective light received by light detecting element 222 is converted from an analog to a digital signal by Analog-to-Digital converter 220. The digitized signal representative of the smoothness of the paper 211 is then transmitted to CPU 230. The output voltage of reflective type photosensor 210 is large when the surface of the printing sheet is smooth, such as when thermal print paper is used. On the other hand, the output voltage tends to be much lower when the printing sheet surface is rough, such as is the case with bond paper.

When biasing power setting motor 206 is rotated in the direction of arrow U, spring supporting member 204 moves in the direction of arrow M. When the distance of this movement is greater than a predetermined amount, thermal head 201 is released from any biasing force applied against platen 207 and ink ribbon 209 and printing sheet 211 can be advanced between platen 207 and print head 201.

Thus, the head biasing mechanism also acts as a head up-down mechanism to release the head in addition to being capable of setting at least two pressure levels of biasing force by suitable rotation of a stepping motor.

Reference is next made to FIG. 7 wherein a graph depicting the relationship between the driving torque of a stepping motor, used as a driving source of the carriage movement in the first embodiment or of the platen movement in the second embodiment, and the driving frequency (Pulses Per Second) is shown. Curve 240 indicates the characteristic curve of a stepping motor used in connection with the present invention. Curve 241 represents a similar characteristic curve for a stepping motor used in connection with a thermal printer constructed in accordance with the prior art. In general, the lower the driving frequency the greater the driving torque required. For example, point P on curve 240 has a lower driving frequency and a higher driving torque than point Q, also on curve 240. Point R on curve 241 requires more driving torque then does corresponding point Q on curve 240 for a given driving frequency. In fact, the same driving torque required at point R on curve 241, will drive the stepping motor used in connection with the thermal printer constructed with the invention at a lower frequency, shown as point P. As a result, a smaller stepping motor with a lower maximum torque can be utilized in the thermal printer constructed in accordance with the present invention. In general, printers constructed in accordance with the present invention in which the biasing force of the thermal print head is reduced in the high speed print mode can advantageously miniaturize the motor and decrease its power consumption to produce a compact efficient thermal printer.

Figure 8B:
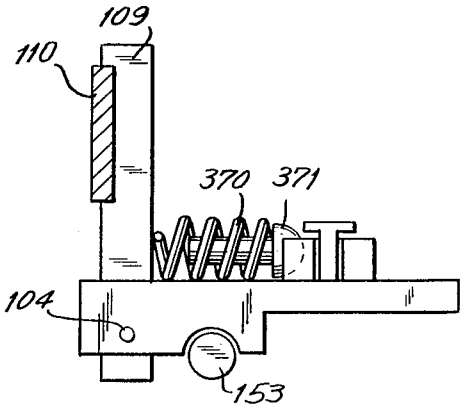
FIGS. 8A and 8B are a top plan view and side elevational view, both partially cut away for clarity purposes of the carriage of a thermal printer constructed in accordance with a third embodiment of the invention.
Figure 8A:
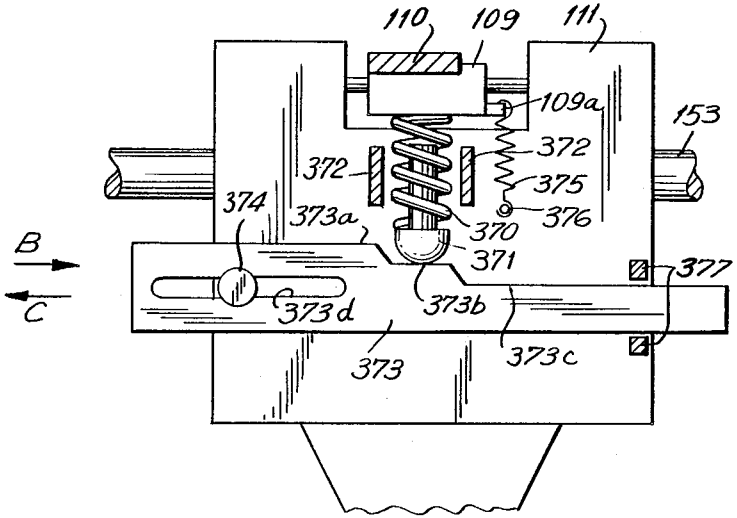

Reference is next made to FIGS. 8A and 8B wherein a carriage supporting a thermal head of the thermal printer constructed in accordance with a third embodiment of the invention is depicted. FIG. 8A is a plan view, and FIG. 8B is a cross-sectional view.

370 is a compressing coil spring, 371 is a spring support member, 372 is a spring guide, 373 is a change lever, 374 is a lever guide pin which engages with an opening 373*d*. A coil spring 375 releases a thermal head 110 from a platen during non-printing and a first end of coil spring 375 is affixed to a pin 376 and its second end is fixed to a tip portion 109*a* provided on radiating plate 109. 377 is a change lever support member.

Change lever 373 has plane surfaces of three levels in contact with the spring support member 371 and is able to reciprocate in the directions of arrows B and C guided by opening 373*d* and lever support members 377. In the same manner as the embodiment in FIGS. 2A and 2B, the change lever is pushed against the side frames of the thermal printer, so that it is able to move in the directions of arrows B and C.

The biasing mechanism comprises compressing coil spring 370, spring support member 371 and change lever 373. When a high biasing force is required, change lever 373 is moved in the direction of arrow B and a contact surface 373*a* which is closest to the thermal head, is selected. When low biasing force is required, a contact surface 373*b* further from the thermal head is selected. When contact surface 373*c* is selected, compressing coil spring 370 does not act on the rear surface of the thermal head, so that the thermal head is biased away from the platen by expanding coil spring 375. Thus, change lever 373 not only serves as means for changing a biasing force but also as a means for releasing a biasing force.

As noted above, in the same manner as the embodiment shown in FIGS. 2A, 2B and 3, a biasing force changing mechanism comprises a motor for moving a thermal head, a change lever, sides frames of a thermal printer and according to this embodiment, a release mechanism further has expanding coil spring 375 in addition to the above members.

As described above, the thermal printer includes a thermal head with heating elements. However, the present invention is also effectively utilized with an electro-thermal transfer printer in which electrodes are used as the print elements and heating is done by a resistive layer applied on a thermal transfer ribbon. In any event, the structure described above is directly applicable.

In accordance with the invention it is possible to consistently obtain high quality printing regardless of the smoothness of the printing sheet. Where the paper is rough, the speed of the thermal head relative to the paper is reduced and the biasing force of the head against the printing sheet is increased so that the permeability of the ink to the printing sheet is improved. In addition, by utilizing the energy application control mechanism, the biasing force is increased and the energy applied to the thermal head is also increased so that the permeability of the ink into the sheet is further enhanced, thereby producing high quality printing on rough printing paper, such as the commonly used bond papers in the United States.

Prior art thermal printers do not have a head up/-down mechanism, resulting in difficulty in setting the paper and ink ribbon.

Where prior art thermal printers have moved the thermal heads at high speed with strong pressure against the paper, smearing of the paper often occurs as a result of the frictional heat of the head. However, in accordance with the present invention, when the thermal head is moved at high speed, the biasing force of the thermal print head is reduced, thereby reducing the frictional effect of the thermal print head and serving to reduce the paper smearing problem. The energy applied to the thermal head is also decreased.

Previous attempts to increase the biasing force of the print head have utilized a separate plunger mechanism which is both expensive and noisy. However, in accordance with the present invention, the motor for moving the thermal head is used in common as a power source also for the head up-down mechanism thereby reducing the cost and maintaining the quiet operation associated with thermal printers.

Accordingly, an improved thermal printer which operates in a high quality print mode by slowing the movement of the print head and increasing the biasing force and energy applied to the print element as well as operating in a high speed print mode in which the head moves quickly relative to the paper while reducing the biasing force of the print head and the energy applied to the print element, while maintaining a sensitivity to the smoothness or roughness of the printing paper for needed printing flexibility, is provided.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A thermal printer for printing on a printing sheet, comprising:

a print head with print elements;

a platen opposing the print head, the printing sheet being located between the print head and platen;

a head up-down mechanism for moving the print head toward and away from the platen establishing the print head in a head down position and head up position, respectively, the head up-down position and head up position, respectivley, the head up-down mechanism having: biasing means including and elastic member for using the print head against the platen at at least two levels of biasing force for printing in the head down position; head release means for selectively relieving the biasing force generated by the elastic member; change means for selecting between the at least two levels of the biasing force produced from the force generated by the elastic member;

movement means for one of moving the print head relative to a printing sheet and moving the printing sheet relative to the print head at at least two speeds; and control means for varying the level of biasing force applied by the biasing means dependent upon the relative speed of movement of the print head and printing sheet.

2. The thermal printer of claim 1 further comprising carriage means for supporting the print head and biasing means, the movement means moving the carriage means relative to the printing sheet.

3. The thermal printer of claim 2 wherein the change means includes the movement means in connection with the carriage means.

4. The thermal printer of claim 3 wherein the change means has a change lever mounted on the carriage means, the change lever being engaged with side frames of the thermal printer by means of the movement means.

5. The thermal printer of claim 4 wherein the head release means includes the change lever of providing the head up position and head down position, the change lever being the same change lever of the change means.

6. The thermal printer of claim 1 wherein the control means causes the biasing means to apply a greater biasing force when there is a lower relative speed of movement and a lower biasing force when there is a higher relative speed of movement.

7. The thermal printer of claim 1 further comprising energy control means for controlling energy applied to the print elements and being adapted to apply at least two different levels of energy to the print elements.

8. The thermal printer of claim 7 wherein the energy control means applies a level of energy to the print elements related to the biasing force.

9. The thermal printer of claim 8 wherein the control means applies energy to the print elements related to the biasing force and the speed of movement of the print head or sheet.

10. The thermal printer of claim 8 further comprising detecting means for detecting the smoothness of the printing sheet.

11. The thermal printer of claim 10 wherein the control means applies a level of biasing force to the print elements based on the smoothness of the printing sheet.

12. The thermal printer of claim 1 wherein the head release means includes a releasing member which is selectively engageable with the biasing means and power means coupled to the releasing member.

13. The thermal printer of claim 12 wherein the power means includes a motor with a worm gear mounted thereon and the releasing member includes a gear portion in engagement with the worm gear and a hooked portion for selectively engaging with the biasing means.

14. The thermal printer of claim 1 wherein the change means has a variable force means coupled to the elastic member for applying a variety of levels of force to the print head.

15. The thermal printer of claim 14 wherein the variable force means includes motor means, rotation of the motor means causing a variation in force applied from the elastic member to the print head.

16. The thermal printer of claim 15 wherein the motor means has a positioning member for determining the support position of a first end of the elastic member, the positioning member being coupled to the first end of the elastic member, the other end of the elastic member being engaged with the head to apply the biasing force to the print head.

17. The thermal printer of claim 15 wherein rotation of the motor means in a first direction increases the force applied to the elastic member and rotation of the motor means in a second direction, opposite to the first direction, results in a reduction in the force applied to the elastic member.

18. The thermal printer of claim 17 wherein the rotation of the motor means a predetermined distance in the second direction results in the release of the biasing force applied to the print head.

19. The thermal printer of claim 1 further comprising detecting means for detecting the smoothness of the printing sheet.

20. The thermal printer of claim 19 wherein the control means controls a level of the biasing force on the print head based on the smoothness of the printing sheets.

21. The thermal printer of claim 1 wherein the elastic member is a coil spring.

22. A thermal printer for printing on a printing sheet, comprising:

a print head with print elements;

a platen opposing the print head, the printing sheet being located between the print head and platen;

biasing means including an elastic member for urging the print head against the platen at at least two levels of biasing force;

movement means for one of moving the print head relative to a printing sheet and moving the printing sheet relative to the print head, at at least two printing speeds; and control means for selecting the biasing force dependent on the speed of relative movement of the print head and printing sheet.

23. The thermal printer of claim 22 wherein the control means selects a greater biasing force when there is a lower relative speed of movement and the control means selects a lower biasing force when there is a greater relative speed of movement.

24. The thermal printer of claim 22 further including a carriage means for supporting the print head and biasing means, and the biasing means includes a transmission lever rotatably coupled to the carriage means at a fulcrum point, the transmission lever including a biasing force application point on a first side of the fulcrum point and a connection point for coupling the transmission lever to the elastic member on the other side of the fulcrum point.

25. The thermal printer of claim 24 wherein the biasing force applied to the print head by the elastic member is varied by varying the ratio of the distance from the fulcrum point to the connection point and the distance between the fulcrum point and the biasing force application point on the transmission lever.

26. The thermal printer of claim 25 wherein the biasing force is varied by changing the distance between the fulcrum point and the connection point of the elastic member.

27. The thermal printer of claim 25 further comprising head release means for selectively relieving the biasing force generated by the elastic member.

28. The thermal printer of claim 24 wherein the transmission lever includes at least two points of engagement for engaging with the change lever, the points of engagement being at different distances from the fulcrum point.

29. The thermal printer of claim 24 wherein the transmission lever has at least three different levels of surfaces releasably engageable with the biasing means.

30. The thermal printer of claim 29 wherein when the biasing means engages with a closer surface of the transmission lever, the biasing force on the print head is increased, and when the biasing means engages with a farther surface of the transmission lever, the biasing force on the print head is decreased.

31. The thermal printer of claim 30 wherein when the biasing means engages with a farthest surface of the transmission lever, the biasing force on the print head is released.

32. The thermal printer of claim 22 wherein the biasing means includes a motor and rotation of the motor in a first direction increases the force applied to the elastic member and rotation of the motor in a second direction, opposite to the first direction, results in a reduction in the force applied to the elastic member.

33. The thermal printer of claim 32 wherein the rotation of the motor a predetermined distance in the second direction results in the release of the biasing force applied to the print head.

34. A thermal printer for printing on a printing sheet, comprising:

a print head with print elements;

a platen opposing the print head, the printing sheet being located between the print head and platen;

biasing means including an elastic member for urging the print head against the platen with a biasing force;

movement means for one of moving the print head relative to a printing sheet and moving the printing sheet relative to the print head;

detecting means for detecting the smoothness of the printing sheet; and control means coupled to the detecting means and biasing means for causing the biasing means to apply a biasing force related to the detected smoothness of the printing sheet.

35. The thermal printer of claim 34 wherein the detecting means includes light emitting means for projecting a signal toward the printing sheet and a detector for detecting the magnitude of the signal reflected from the printing sheet.

36. The thermal printer of claim 34 wherein the control means causing the biasing means to apply a biasing force inversely related to the detected smoothness of the printing sheet.

37. A thermal printer for printing on a printing sheet, comprising:

a print head with print elements;

a platen opposing the print head, the printing sheet being located between the print head and platen;

a head up-down mechanism for moving the print head toward and away from the platen establishing the print head in a head down position and head up position, respectively, the head up-down mechanism including biasing means including an elastic member for urging the print head against the platen at at least two levels of biasing force for printing;

change means for selecting between the at least two levels of the biasing force produced from the force generated by the elastic member, the change means including a motor, rotation of the motor causing a variation in the biasing force applied to the print head; and carriage means for supporting the print head and biasing means, and movement means for moving the print head and carriage means relative to the printing sheet; the change means including the movement means and carriage means, the motor in the change means further powering the movement means.

38. The thermal printer of claim 37 wherein the thermal printer further includes side frames and the change means includes a change lever mounted on the carriage means, the change lever selectively engaging with the side frames in response to movement of the carriage and print head by the movement means.

39. The thermal printer of claim 38 wherein the head release means includes the change lever for providing the head up position and head down position, the change lever being the same change lever of the change means.

* * * * *